US006409132B2

(12) United States Patent
Heisler et al.

(10) Patent No.: US 6,409,132 B2
(45) Date of Patent: Jun. 25, 2002

(54) ATTACHMENT BRACKET FOR A RAIL

(75) Inventors: Jon Charles Heisler, New Carlisle; Andrew Eric Wildman, Springfield; Samuel Anthony Ferralli, Dayton; Douglas Joseph Noll, Troy, all of OH (US)

(73) Assignee: Display Edge Technology, Ltd., Troy, OH (US)

( * ) Notice: Subject to any disclaimer, the term of this patent is extended or adjusted under 35 U.S.C. 154(b) by 0 days.

(21) Appl. No.: 09/302,650

(22) Filed: Apr. 30, 1999

(51) Int. Cl.[7] ..... E04G 5/06
(52) U.S. Cl. ..... 248/220.22; 40/642.2
(58) Field of Search ..... 248/220.22, 223.41, 248/220.21, 243; 40/642.02; 403/297, 362

(56) References Cited

U.S. PATENT DOCUMENTS

| | | | |
|---|---|---|---|
| 2,362,273 | A | 11/1944 | Hopp |
| 2,827,718 | A | 3/1958 | Howard |
| 3,014,294 | A | 12/1961 | Singer |
| 3,015,177 | A | 1/1962 | Hembd et al. |
| 3,084,463 | A | 4/1963 | Guyer et al. |
| 3,086,308 | A | 4/1963 | Ternouth |
| 3,815,519 | A | 6/1974 | Meyer |
| 3,889,408 | A | 6/1975 | Offner |
| 3,918,668 | A | 11/1975 | Thorpe |
| 3,955,296 | A | 5/1976 | Kapstad |

(List continued on next page.)

FOREIGN PATENT DOCUMENTS

| | | |
|---|---|---|
| BE | 648368 | 9/1964 |
| EP | 0299355 | 7/1988 |
| EP | 0722158 | 12/1995 |
| GB | 2207539 | 7/1987 |
| WO | 9307785 | 4/1993 |
| WO | 9319448 | 9/1993 |
| WO | 9400895 | 1/1994 |
| WO | 9422125 | 9/1994 |
| WO | 9506935 | 3/1995 |
| WO | 9609619 | 3/1996 |
| WO | 9614630 | 5/1996 |
| WO | 9720437 | 6/1997 |

OTHER PUBLICATIONS

Specification for currently pending patent application Ser. No. 09/118,606 filed Jul. 17, 1998 for Article–Information Display System Using Electronically Controlled Tags.
Specification for currently pending patent application Ser. No. 09/253,338 filed Feb. 19, 1999 for Shelf–Edge Display System.

*Primary Examiner*—Ramón O Ramirez
(74) *Attorney, Agent, or Firm*—Thomson Hine LLP

(57) ABSTRACT

A bracket for coupling a rail having an upper slot and a lower slot to a shelf edge having an upper groove and a lower groove. The bracket comprises a central body portion, an upper flange extending generally upwardly from the body portion, a lower flange extending generally downwardly from the body portion, and a plate. The plate is received between the upper and the lower flanges such that as the plate is moved toward the body, the plate urges the upper flange and the lower flange into the upper and lower groove, respectively, to couple the bracket to the shelf edge. The bracket further comprises a first upper tang extending generally upwardly from the body portion and a first lower tang extending generally downwardly from the body portion, the upper tang and lower tang being shaped to be received in the upper and lower slot, respectively. At least one of the tangs has at least one tang groove therein to facilitate the attachment of the bracket to the rail.

49 Claims, 6 Drawing Sheets

U.S. PATENT DOCUMENTS 4,002,886 A 1/1977 Sundelin
4,155,091 A 5/1979 Vorie
4,167,073 A 9/1979 Tang
4,179,138 A 12/1979 Bogdanovic
4,301,987 A 11/1981 Conway
4,346,453 A 8/1982 Drapeau et al.
4,500,880 A 2/1985 Gomersall et al.
4,531,311 A 7/1985 Howard et al.
4,556,183 A 12/1985 Greenberger
4,562,657 A 1/1986 Murray
4,694,600 A 9/1987 Murray
4,697,812 A * 10/1987 Rudell et al. ..... 273/86 B
4,745,695 A 5/1988 Hetzer
4,798,014 A 1/1989 Stoerzinger et al.
4,805,331 A 2/1989 Boggess et al.
4,871,135 A 10/1989 Thalenfeld
4,881,707 A 11/1989 Garfinkle
4,888,709 A 12/1989 Revesz et al.
4,899,974 A 2/1990 Wear et al.
4,939,861 A 7/1990 Soubliére
4,962,466 A 10/1990 Revesz et al.
5,044,104 A 9/1991 Hopperdietzel
5,111,196 A 5/1992 Hunt
5,198,644 A 3/1993 Pfeiffer et al.
5,233,773 A 8/1993 Reynolds
5,241,467 A 8/1993 Failing et al.
5,289,652 A 3/1994 Kringel et al.
5,332,108 A 7/1994 Blass
5,348,485 A 9/1994 Briechle et al.
5,374,815 A 12/1994 Waterhouse et al.
5,406,271 A 4/1995 Sonnendorfer et al.
5,420,606 A 5/1995 Begum et al.
5,442,343 A 8/1995 Cato et al.
5,448,226 A 9/1995 Failing, Jr. et al.
5,461,809 A 10/1995 Fowler et al.
5,465,085 A 11/1995 Caldwell et al.
5,467,474 A 11/1995 Ackerman et al.
5,473,832 A 12/1995 Briechle et al.
5,473,833 A 12/1995 Ostrovsky
5,532,465 A 7/1996 Waterhouse et al.
5,535,969 A 7/1996 Duffy, Jr.
5,537,126 A 7/1996 Kayser et al.
5,539,393 A 7/1996 Barfod
5,548,282 A 8/1996 Escritt et al.
5,553,412 A 9/1996 Briechle et al.
5,564,210 A 10/1996 Hetzer et al.
5,575,100 A 11/1996 Marvin et al.
5,583,487 A 12/1996 Ackerman et al.
5,611,512 A 3/1997 Cholet
5,668,560 A 9/1997 Evans et al.
5,736,967 A 4/1998 Kayser et al.
5,791,080 A 8/1998 Hamano

* cited by examiner

ATTACHMENT BRACKET FOR A RAIL

FIELD OF THE INVENTION

The present invention is directed to a bracket for use in an article information display system, and more particularly, to a bracket for coupling a rail to a conventional shelf edge for use in an article information display system.

BACKGROUND OF THE INVENTION

Article information display systems are commonly used to provide variable information about various products. The system typically utilizes price tags having a variable display surface, such as an LCD (liquid crystal display) surface, to electronically display information about an associated, adjacent product. For example, price, price per unit weight, or other information may be displayed on the LCD display. A system controller controls the information displayed on a price tag. In this manner, the displayed information can be updated from a central location, and the controller can be coupled to the check-out scanners to ensure that the check-out price is consistent with the displayed price. Such article information display systems may be used in supermarkets, drug stores, grocery stores, hardware stores, auto parts stores, or other settings where variable article information is desired to be displayed.

In order to install such a display system, an auxiliary rail that is designed to receive and interact with an electronic display tag is mounted to conventional store shelves. Existing store shelves are preferably retrofitted to receive the auxiliary rail thereon. The auxiliary rail includes a conductor loop running along its length, and the electronic tag includes a coil extending around its periphery. When the electronic tag is mounted with the auxiliary rail, the conductor in the rail communicates with the coil in the tag by inductive coupling to convey information from the controller to the tag.

Various brackets and attachment means have been designed for attaching an auxiliary rail to an existing conventional shelf edge. For example, U.S. application Ser. No. 09/253,338 filed Feb. 19, 1999, hereby incorporated by reference, discloses various attachment brackets. The bracket of the present invention provides several advantages over the attachment methods.

SUMMARY OF THE INVENTION

The present invention is a bracket that enables the installation of auxiliary rails and other components of an electronic display tag system onto conventional, preexisting store shelving assemblies. The bracket does not require any structural modification to preexisting shelving assemblies, is quickly and easily mounted to the shelf edge using conventional hand tools, and does not require removal of products from the shelves. The bracket also includes one or more rail receiving portions, such as grooves, to facilitate the attachment of the bracket to the rail, the grooves receiving melted portions of the rail when the rail is attached to the bracket by heat staking. Furthermore, the bracket of the present invention is shaped to reduce detuning of the electronic tags that are received in the rail, thereby improving the operating characteristics of the display system.

In particular, the present invention is a bracket for coupling a rail having an upper slot and a lower slot to a shelf edge having an upper groove and a lower groove. The bracket comprises a central body portion, an upper flange extending generally upwardly from the body portion, a lower flange extending generally downwardly from the body portion, and a plate. The plate is received between the upper and the lower flanges such that as the plate is moved toward the body, the plate urges the upper flange and the lower flange into the upper and lower groove, respectively, to couple the bracket to the shelf edge. The bracket further comprises a first upper tang extending generally upwardly from the body portion and a first lower tang extending generally downwardly from the body portion, the upper tang and lower tang being shaped to be received in the upper and lower slot, respectively. At least one of the tangs has at least one rail receiving portion therein to facilitate the attachment of the bracket to the rail.

The present invention is also directed to a rail for receiving an electronic display tag therein and for being coupled to a bracket. The rail comprises a central body having a front surface and a rear surface, an upper finger extending from the front surface, and a lower finger extending from the front surface and spaced from the upper finger. The upper finger and the lower finger define a channel to receive an electronic display tag therein. The rail further comprises an upper lip extending from the rear surface and defining an upper slot for receiving an upper tang of a bracket therein, the upper lip being shaped to maintain the upper tang in the upper slot. The rail further includes a lower lip extending from the rear surface and defining a lower slot for receiving a lower tang of the bracket therein, the lower lip being shaped to maintain the lower tang is the lower slot.

Other objects and advantages of the present invention will be apparent from the following description, the accompanying drawings and the appended claims.

DETAILED DESCRIPTION

Figure 1:
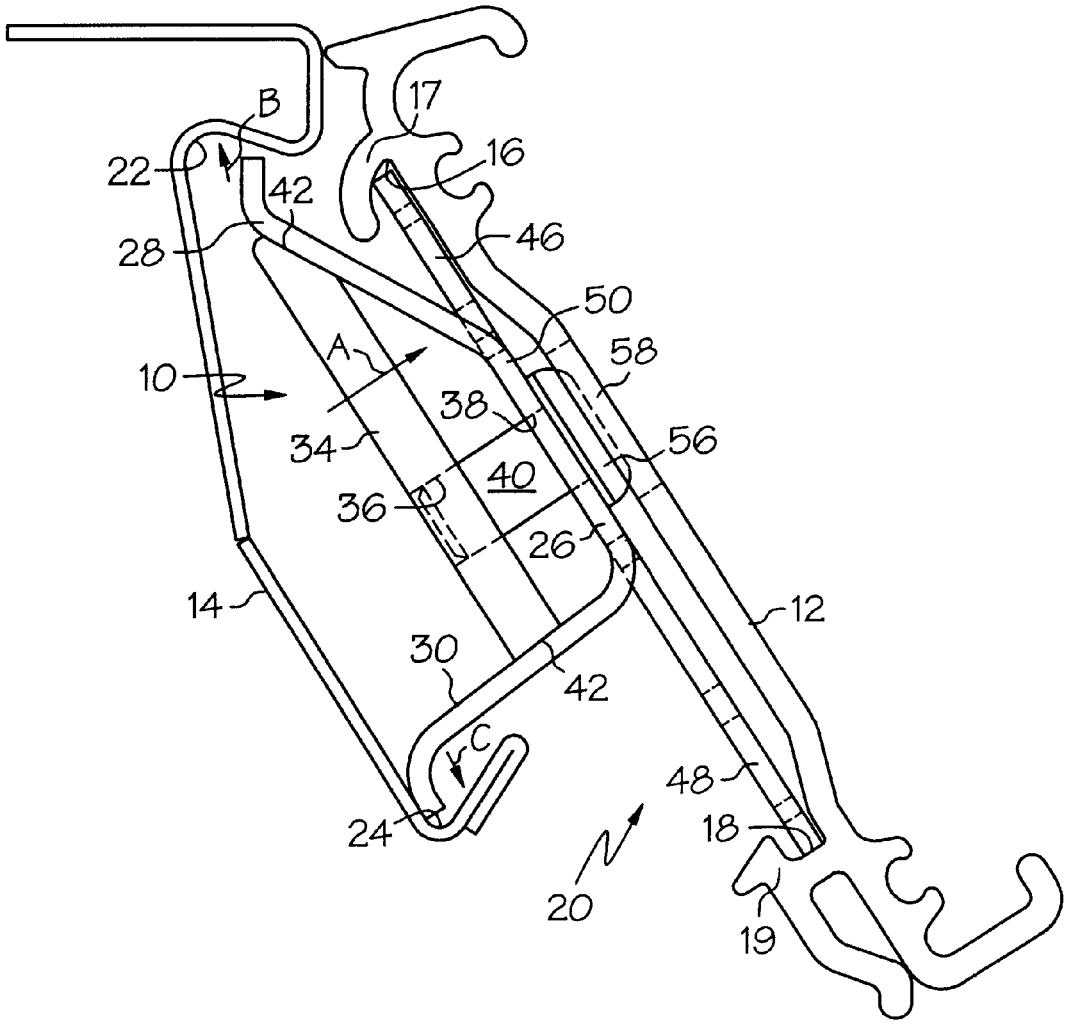
FIG. 1 is an end view of one embodiment of the bracket of the present invention, shown mounted to a rail and a shelf edge.

As shown in FIG. 1, the bracket 10 of the present invention is used to couple a rail 12 to a conventional shelf edge 14. The rail 12 includes an upper slot 16 and a lower slot 18 along its rear surface 20, and the shelf edge 14 includes an upper groove 22 and a lower groove 24. The upper slot 16 is defined by an upper lip 17, and the lower slot is defined by a lower lip 19. The bracket 10 includes a central body portion 26, and has an upper flange 28 extending generally rearwardly and upwardly from the body portion 26 and a lower flange 30 extending generally rearwardly and downwardly from the body portion 26. The flanges 28, 30 are shaped to be received in the upper and lower grooves 22, 24 to couple the bracket 10 to the shelf edge 14. The upper flange 28 includes a slot 32 (FIG. 2) to provide flexibility to the upper flange 28. A plate 34 is received between the upper 28 and lower flanges 30, and the plate 34 and the body 26 each include a hole 36, 38 that receives a threaded fastener 40 therethrough. The plate 34 includes a pair of end surfaces 42 that engage the flanges 28, 30.

Figure 2:
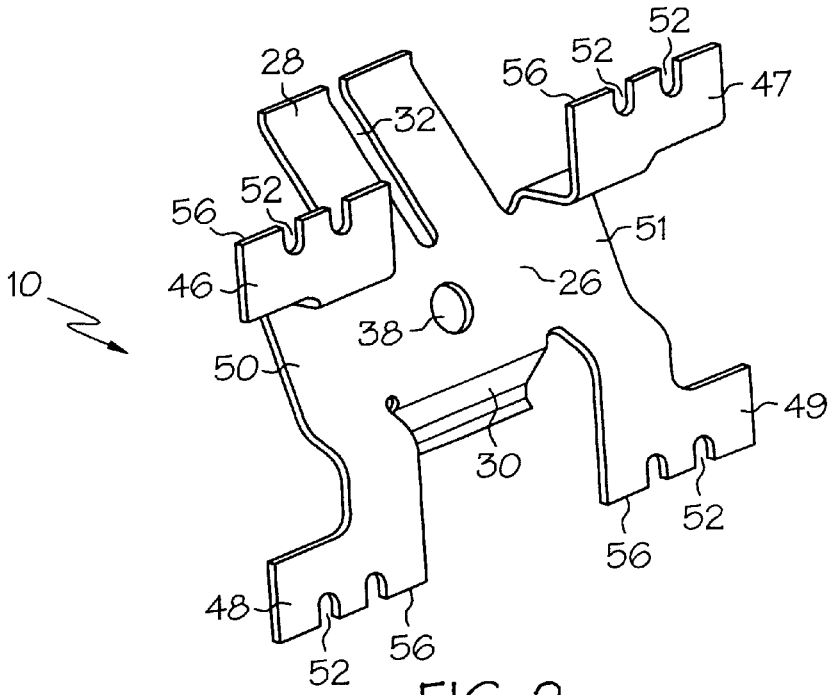
FIG. 2 is a perspective view of the bracket of FIG. 1.
Figure 3:
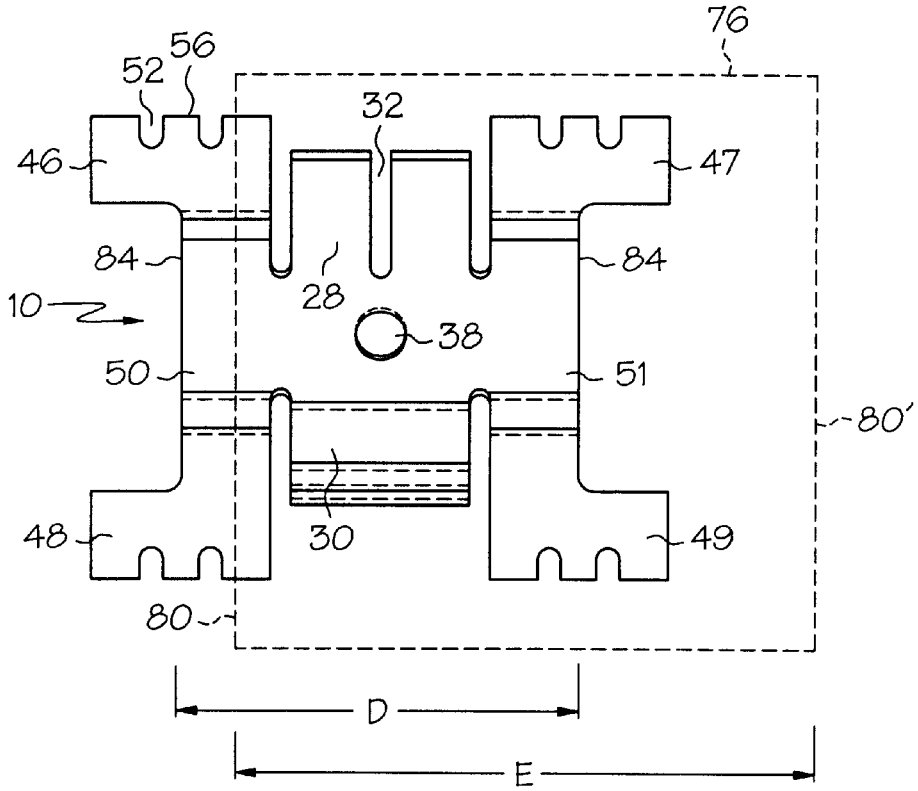
FIG. 3 is a front view of the bracket of FIG. 1.

As shown in FIGS. 2–3, the bracket 10 further includes first and second upper tangs 46, 47 extending generally upwardly from the body 26, and first and second lower tangs 48, 49 extending generally downwardly from the body 26. The tangs 46, 47, 48, 49 are shaped to be received in the upper 16 and lower 18 slots of the rail 12 (FIG. 1), to couple the bracket 10 to the rail 12. A first vertically extending arm 50 joins the first upper tang 46 and the first lower tang 48 (FIG. 3), and a second vertically extending arm 51 joins the second upper tang 47 and the second lower tang 49.

Figure 6:
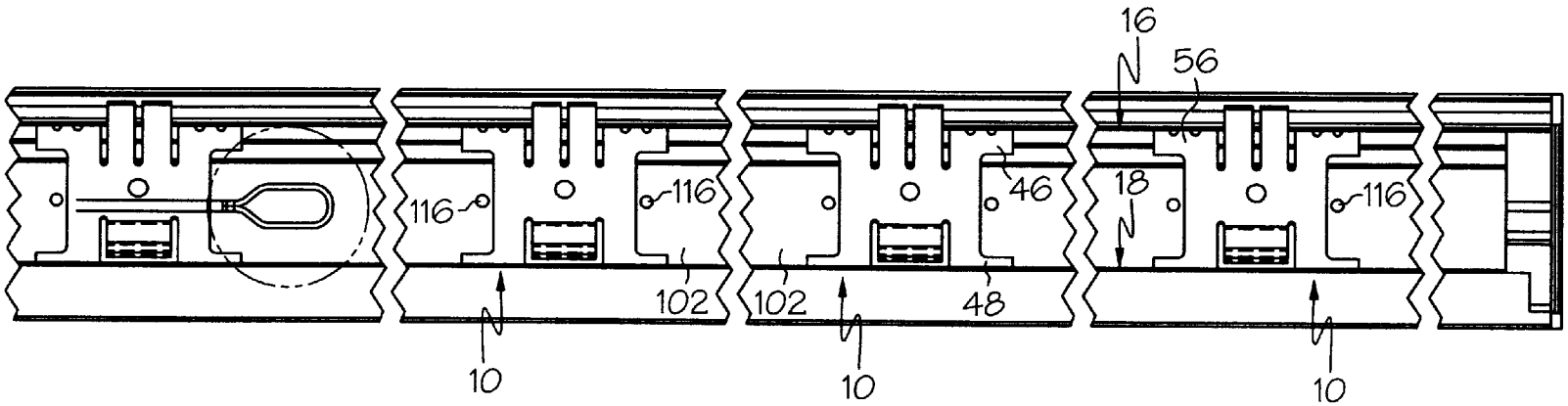
FIG. 6 is a rear view of one embodiment of a rail of the present invention, with a plurality of brackets attached thereto.

The rail 12 is preferably made from plastic, and the bracket 10 is preferably formed of stainless steel or spring steel, although a wide variety of materials may be used, including nonmetal materials. The rail 12 is preferably attached to the bracket 10 by heat staking, which entails heating the rail 12 and/or bracket 10 until portions of the rail 12 melt and conform around the bracket 10, and allowing the melted portions to cool and harden. As shown in FIGS. 1–2, each tang 46, 47, 48, 49 preferably includes one or more grooves 52 formed therein. During heat staking operations, portions of the rail 12 surrounding the grooves 52 tends to melt and flow into the grooves 52 on the tangs 46, 47, 48, 49. In this manner, when the melted portions harden, the rail 12 is firmly coupled to the bracket 10. The grooves 52 are preferably formed in an outer surface 56 of the tangs 46, 47, 48, 49 and the grooves 52 preferably extend about 2 mm into the outer surface 56. FIG. 6 illustrates an alternate embodiment of the rail 102, and as shown in FIG. 6, a plurality of brackets 10 may be coupled to a single rail 102 (or a rail 12) in the above-described manner. However, it should be understood that only a single bracket may be sufficient to couple a rail 12, 102 to a shelf edge 14. The bracket 10 may also be attached to the rail 12, 102 by an adhesive. The brackets 10 are preferably coupled to the rail 12 before being shipped to the customer. In this manner, the preassembled rail/bracket combination reduces the installation time for the customer.

Figure 4:
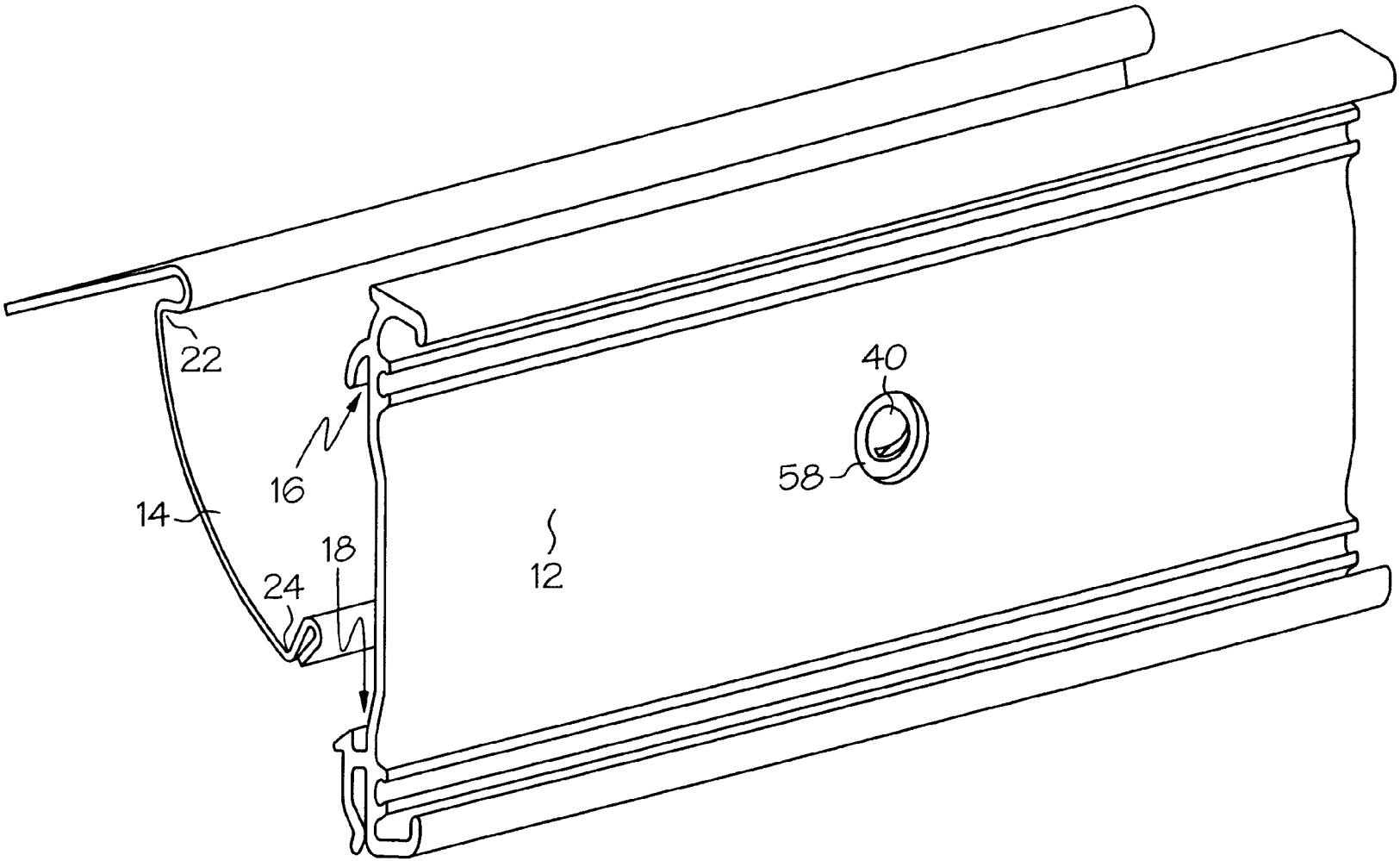
FIG. 4 is a perspective view of a rail coupled to a shelf edge.

In order to couple the bracket/rail assembly to a shelf edge 14, the brackets 10 are placed loosely into the shelf edge 14 such that the upper flange 28 of each bracket 10 is received in the upper groove 22 and the lower flange 30 is received in the lower groove 24 (FIG. 1). The fastener 40 is then rotated to pull the plate 34 toward the body 26 of the bracket 10 (indicated by arrow A). The end surfaces 42 on the plate 34 engage the flanges 28, 30, thereby urging the flanges 28, 30 into the grooves 22, 24 (indicated by arrows B and C) until they are fixed within the grooves 22, 24 by compression. The head 56 of the fastener 40 is preferably larger than the hole 38 in the body 26 such that the head 56 engages the body 26 during tightening to provide an opposing force during movement of the plate 34 in the direction of arrow A. A hole 58 is formed in the rail 12 to provide access to the head 56 of the fastener 40, and the hole 58 is larger than the head 56 of the fastener 40 to allow the fastener to pass therethrough. After the rail/bracket combination is coupled to the shelf edge 14, the hole may be covered 58 with any acceptable piece of sheet-like material, preferably an adhesive material that matches the color of the rail 12. A generally cylindrical plug may also be received into the hole 58. FIG. 4 illustrates a rail 12 and shelf edge 14 after the rail 12 is attached to the shelf edge 14.

In an alternate embodiment, the bracket 10 is of a two piece construction wherein the tangs 46, 47, 48, 49 are made from a first piece of material, and the flanges 28, 30 are made from a second piece of material. The second piece of material that includes the flanges 28, 30 may be made from a thinner material, which provides more flexibility to the flanges, and is cheaper to manufacture. The first piece of material that includes the tangs 46, 47, 48, 49 may be made from a relatively thicker piece of metal to provide robustness to the bracket 10. The first piece and second pieces of material may be joined by a variety of conventional methods, including spot welding.

In yet another embodiment, the bracket 10 may include one or more holes in the tangs 46, 47, 48, 49. In this embodiment, when the tangs are heat staked to the rail, the melted portions of the rail 12 may flow through the holes formed in the tangs. Further alternately, dimpled or recessed portions may be formed in the tangs 46, 47, 48, 49 to receive melted portions of the rail therein.

Figure 5:
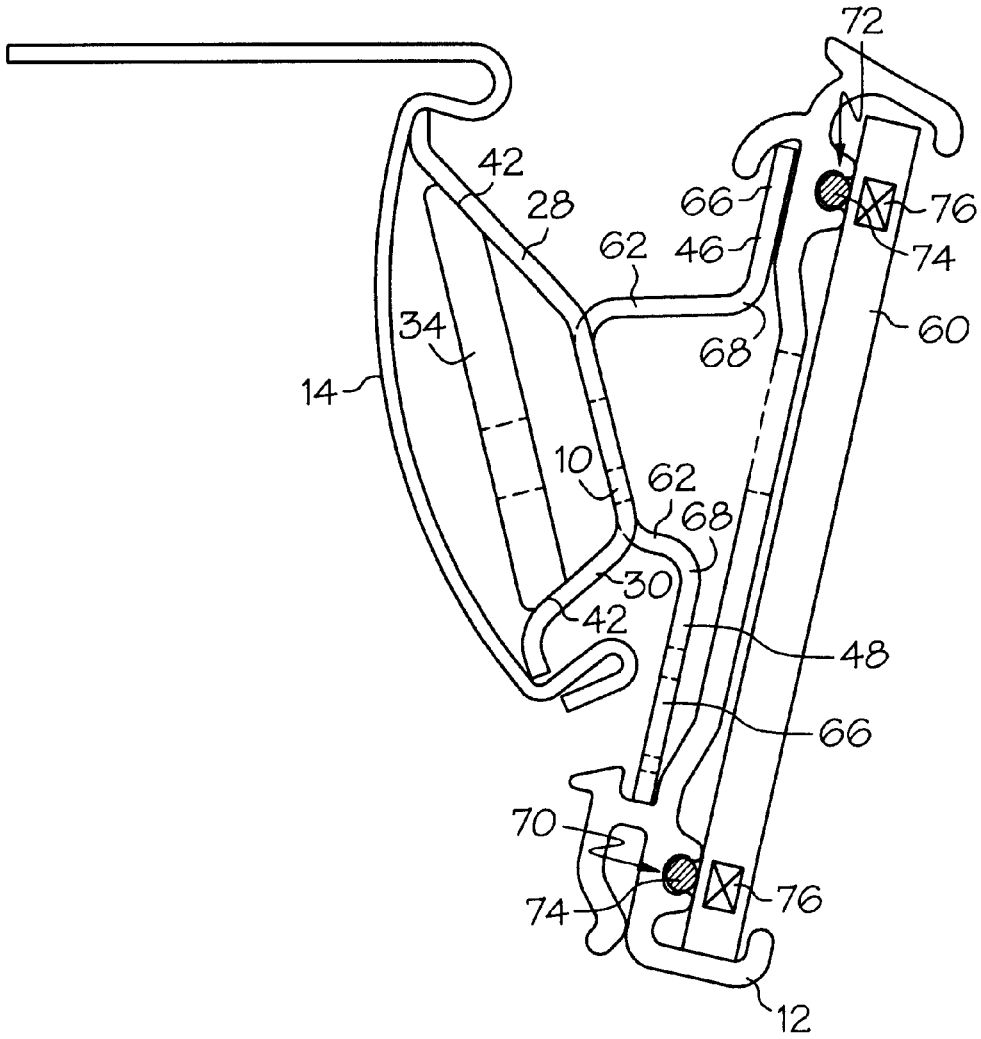
FIG. 5 is a side view of an alternate embodiment of the bracket of the present invention, shown with a rail, shelf edge, and display tag.

As shown in FIG. 5, the shape of the upper 46, 47 and lower tangs 48, 49 may be varied to change the display angle of the rail 12 and a display tag 60. For example, the tangs may each include a generally horizontally extending section 62 and a generally vertically extending section 66 joined by an elbow 68 to vary the display angle. Thus, the bracket 10 of FIG. 5 may be used on an upper shelf edge to angle the tag 60 downwardly for easier viewing and access. Similarly, an oppositely-angled bracket may be used to angle a rail and tag upwardly for use on a lower shelf edge. In the embodiment of FIG. 5, the end surfaces 42 of the plate 34 are both tapered to engage the flanges 28, 30.

As shown in FIG. 5, the rail 12 includes upper 72 and lower 70 channels for receiving a conductor 74 therein. The rail 12 receives a display tag 60 therein, and the tag 60 has a coil 76 extending around its periphery. The conductor 74 is used to transmit information and power to the coil 76 of the display tag 60 by means of inductive coupling. The coil 76 is electrically coupled to a capacitor, and the coil 76 and the capacitor are selected to resonate at a certain frequency, such as 50 kHz. It is known that the presence of conductive materials, such as metals, near the coil 76 may induce eddy currents in the coil 76, which may change the inductance of the coil 76. Thus, because the bracket 10 is preferably formed of metal, too much metal of the bracket 10 adjacent to the coil 76 can reduce the power delivered to the tag at the resonant frequency (i.e., "detune" the tag).

Accordingly, the bracket 10 is sized such that both of the vertical arms 50, 51 cannot be adjacent the coil 76 at any one time. For example, FIG. 3 illustrates the coil 76 of the tag 60 superimposed in hidden lines over the bracket 10, the coil 76 having a pair of vertically-extending segments 80, 80'. It is seen that the vertical arms 50, 51 of the bracket 10 are located such that if one of the vertical arms 50 is superimposed over one of the vertically-extending segments 80 of the coil 76, the other vertical arm 51 is not superimposed over the other vertically-extending segment 80' of the coil 76. In the illustrated embodiment, the horizontal distance D between the vertical arms 50, 51 is smaller than the horizontal distance E between the vertical segments 80, 80' of the tag coil 76 for the smallest tag 60 that is expected to be used in the system. In this manner, both of the arms 50, 51 cannot simultaneously overlie the vertical segments 80, 80' of the coil 76, which helps to minimize detuning of the system. The vertical arms 50, 51 also each include a cutout 84 to reduce the amount of metal that is located adjacent the vertical segments 80, 80' of the tag coil 76. Additional cutouts may also be located in the horizontally extending portions of the bracket 10 to further reduce interference between the bracket 10 and the coil 76. The angling of the flanges 28, 30 away from the body 26 also helps to reduce the detuning of the coil 76.

When the rail 12 is mounted to the shelf edge 14, it may be desired to provide a protective structure to prevent anyone from grabbing the top surface 88 of the rail 12 and pulling the rail 12 off the shelf edge 44 or bracket 10. Accordingly, an alternate embodiment of the rail 102 shown in FIG. 7 includes a cover 90 that extends generally rearwardly from a top surface 88 of the rail 12 to block access to the rear surface 20 of the rail 12. The cover 90 blocks customers from wrapping a hand around the top surface 88 of the rail 12 to provide leverage for pulling the rail 12 off the shelf edge 14. The cover 90 also blocks debris and other matter from falling behind the back of the rail 102.

Figure 7:
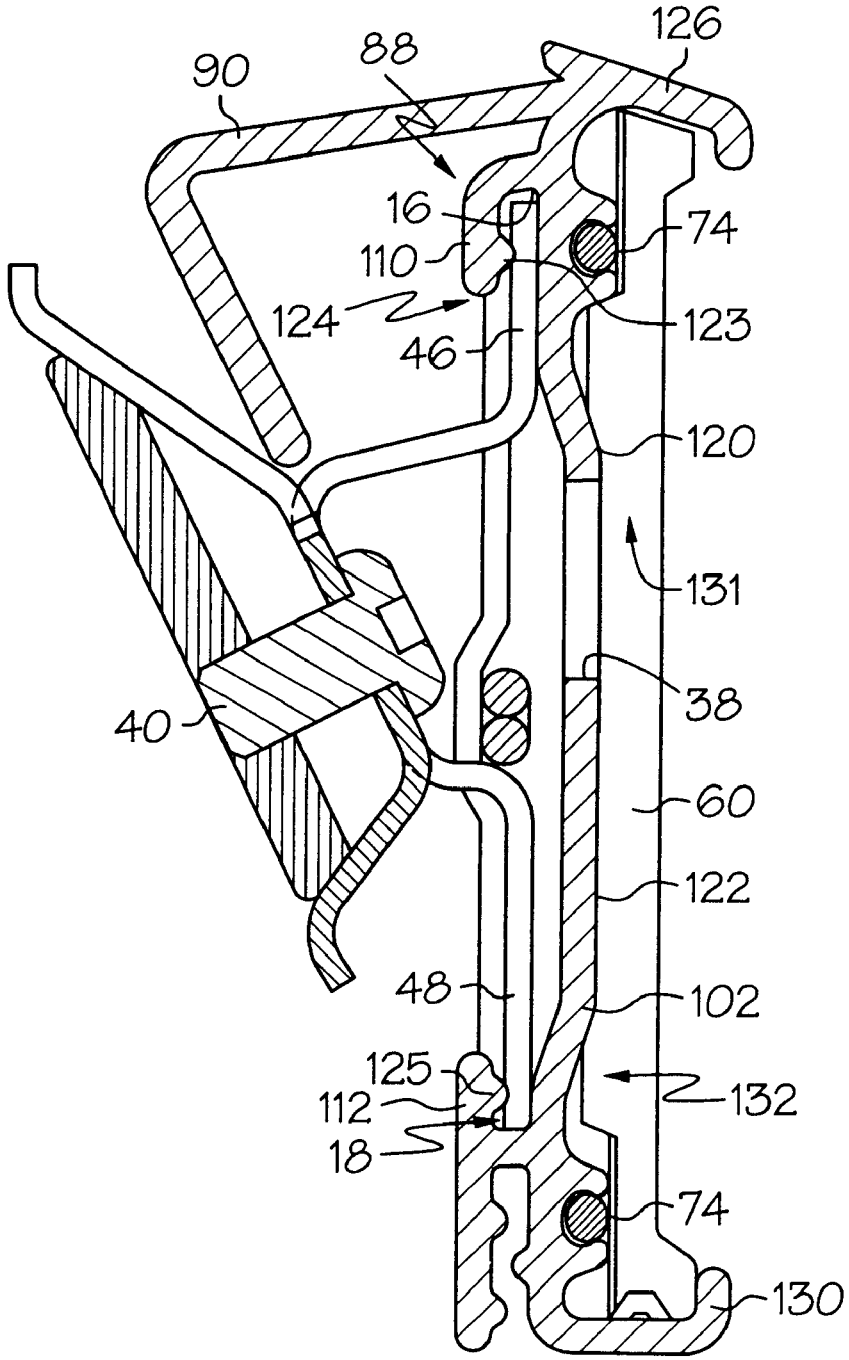
FIG. 7 is a side view of the bracket of FIG. 5, shown with an alternate embodiment of the rail of the present invention, a shelf edge and a display tag.

The rail 102 of FIG. 7 includes a body 120 having a front surface 122 and a rear surface 124. An upper finger 126 extends from the top surface 88 of the body 120, and a lower finger 130 extends from the lower surface 132 of the body 120. The fingers 126, 130 are shaped and located to define a channel 131 that receives a tag 60 therein. An upper lip 110 extends generally rearwardly and downwardly from the rear surface 124, and defines an upper slot 16 that receives the upper tangs 46, 47 therein. A lower lip 112 extends generally rearwardly and upwardly from the rear surface 124, and defines a lower slot 18 that receives the lower tangs 48, 49 therein. The upper lip 110 and lower lip 112 extend downwardly and upwardly, respectively, along the rear surface 20 of the rail 102 for a significant distance, such that the lips 110, 112 retain the upper tangs 46, 47 and the lower tangs 48, 49 of the bracket 10 therein. The lips 110, 112, preferably extend a distance of about 0.100 to about 0.150 inches. In this manner, the bracket 10 may be received in the rail 102 without any other attachment methods such as heat staking, adhesives, or the like.

As shown in FIG. 6, the rail 102 includes a raised protrusion 116, said as a dimple or a swedge, on either side of the bracket 10. The protrusions 116 extend generally outwardly from the rear surface 124 of the rail 102 to limit the lateral sliding of the brackets 10 within the rail 102. In this manner, the spacing of the brackets 10 is maintained to provide uniform support, and the fastener 40 is maintained in alignment with the hole 38 in the rail 102 to ensure access to the fastener 40. In the embodiment shown in FIG. 7, the rail 102 includes a pair of upper protrusions 123 that extends generally inwardly from the upper lip 110 and a pair of lower protrusions 125 that extend generally inwardly from the lower lip 112. The set of upper protrusions are located on either side of the the tag 60, as are the set of lower protrusions 125. The upper 123 and lower 125 protrusions limit the lateral sliding of the bracket 10 in the rail. The protrusions 123, 125 are preferably formed by swedging. Only a single pair of either upper 123 or lower 125 protrusion may be needed to block a single bracket 10 from sliding in the rail 102, but both upper and lower sets are shown for illustrative purposes.

While the forms of the apparatus herein constitute a preferred embodiment of the invention, the present invention is not limited to the precise forms described herein, and changes may be made therein without departing from the scope of the invention.

What is claimed is:

1. A bracket for coupling a rail having an upper slot and a lower slot to a shelf edge having an upper groove and a lower groove, the bracket comprising:

a central body portion;

an upper flange coupled to and extending generally upwardly from said body portion;

a lower flange coupled to and extending generally downwardly from said body portion;

a plate received between said upper and said lower flanges such that as said plate is moved toward said body said plate urges said upper flange and said lower flange into said upper and lower groove, respectively, to couple said bracket to said shelf edge;

a first upper tang coupled to and extending generally upwardly from said body portion; and a first lower tang coupled to and extending generally downwardly from said body portion, said upper tang and lower tang being shaped to be received in said upper and lower slot, respectively, at least one of said first tangs having at least one rail receiving portion located at a distal end thereof to facilitate the attachment of said bracket to said rail.

2. The bracket of claim 1 wherein said rail receiving portion is a groove in said tang shaped to receive melted portions of said rail therein when said rail is attached to said bracket by heat staking.

3. The bracket of claim 2 wherein said tang groove is formed in an outer surface of said at least one first tang.

4. The bracket of claim 3 wherein said tang groove extends about 2 mm into said tang.

5. The bracket of claim 1 wherein the other of said first tangs includes at least one rail receiving portion therein to facilitate the attachment of said bracket to said rail.

6. The bracket of claim 1 wherein said rail receiving portion is a hole that is shaped to receive melted portions of said rail therein when said rail is attached to said bracket by heat staking.

7. The bracket of claim 1 wherein said at least one first tang includes a plurality of rail receiving portions therein to facilitate the attachment of said bracket to said rail.

8. The bracket of claim 1 and wherein said first upper tang and said first lower tang are joined by a first arm, and wherein said bracket further includes a second upper tang and a second lower tang extending from said body, said second upper tang and said second lower tang being joined by a second arm.

9. The bracket of claim 8 wherein said rail is shaped to receive an electronic tag having a coil, and wherein said first and second arms are located such that at least one of said arms is spaced from a coil of an electronic tag received in said rail to reduce detuning of said coil when said tag is located adjacent said bracket.

10. The bracket of claim 8 wherein said coil includes a pair of laterally spaced vertical portions, and wherein the distance between said first and second arms is less than the distance between said vertical portions when said tag is located adjacent said bracket.

11. The bracket of claim 8 wherein each of said arms includes a cut-out to reduce detuning said coil.

12. The bracket of claim 1 wherein said first tangs are made from a first piece of sheet-like material, and wherein said flanges are made from a second piece of sheet-like material.

13. The bracket of claim 1 wherein said plate urges said flanges outwardly relative said plate when said plate is moved toward said body.

14. The bracket of claim 13 wherein said plate includes a pair of outer surfaces that engage said flanges when said plate is moved toward said body.

15. The bracket of claim 1 wherein said first tangs each include an elbow portion to angle said rail relative said bracket when said rail is mounted on said bracket.

16. The bracket of claim 1 wherein said body has a hole and said plate has a hole, and wherein said bracket further includes a threaded fastener passed through said hole in said body and through said hole in said plate such that rotation of said fastener causes said plate to move relative said body.

17. The bracket of claim 16 wherein a head of said fastener is larger than said hole in said body.

18. The bracket of claim 1 in combination with said rail.

19. The bracket and rail of claim 18 wherein said bracket is coupled to said rail by heat staking, and wherein said rail receiving portion receives portions of said rail therein.

20. The bracket and rail of claim 18 wherein said rail includes a conductor therein to exchange information and power with an electronic tag having a coil when said tag is received in said rail.

21. The bracket and rail of claim 18 further comprising a threaded fastener passed through said body and said plate such that rotation of said fastener causes said plate to move relative said body, and wherein said rail includes a hole to provide access to said fastener.

22. The bracket and rail of claim 21 wherein said hole in said rail is larger than a head of said fastener.

23. The bracket and rail of claim 22 further comprising a piece of sheet-like material covering said hole.

24. The bracket and rail of claim 22 further comprising a plug received in said hole.

25. The bracket and rail of claim 18 wherein said rail includes a cover extending generally rearwardly from a top surface of said rail to block access to a rear surface of said rail.

26. The bracket and rail of claim 18 wherein said upper slot is defined by an upper lip and said lower slot is defined by a lower lip, and wherein said upper lip is shaped to maintain said upper tang in said upper slot and said lower lip is shaped to maintain said lower tang in said lower slot.

27. The bracket and rail of claim 26 wherein said upper lip and said lower lip extend about 0.100 to about 0.150 inches along a rear surface of said rail.

28. The bracket and rail of claim 18 wherein said rail further includes a pair of protrusions to limit said bracket from sliding within said rail.

29. The bracket and rail of claim 28 wherein said protrusions extend into at least one of said upper slot and said lower slot, and wherein said bracket is received between said protrusions.

30. The bracket of claim 1 wherein said bracket is made from spring steel.

31. The bracket of claim 1 wherein said upper flange includes a generally vertically extending slot to provide flexibility to said upper flange.

32. The bracket of claim 1 wherein the at least one rail-receiving portion is located at a free end tip of the associated one of said first tangs.

33. The bracket of claim 32 wherein each of said first upper tang and said first lower tang are relatively thin and plate-like, and wherein said at least one rail-receiving portion includes at least one cutout through the thickness of the associated one of said first tangs.

34. The bracket of claim 33 wherein at least one rail-receiving portion is generally semicircular in top view.

35. An assembly for connecting a plurality of electronic display tags to a shelf edge having an upper groove and a lower groove, the assembly comprising:

a rail having a front face including a channel for receiving electronic display tags therein, and a back side including an upper slot and a lower slot formed thereon; and a plurality of brackets positioned along the back side of the rail, each bracket including:

(i) a body portion including a hole therethrough;

(ii) at least a first upper tang positioned in the upper slot of the rail and at least a first lower tang positioned in the lower slot of the rail, the tangs extending from the body portion and attaching the bracket to the rail;

(iii) at least one lower flange for positioning in a lower groove of a shelf edge and at least one upper flange for positioning in an upper groove of said shelf edge, the flanges extending from the body portion;

(iv) a plate positioned between the flanges and including a hole therethrough which aligns with the body portion hole;

(v) a fastener positioned through the aligned holes for holding the plate adjacent the flanges, the head of said fastener abutting against said body portion, the fastener being rotatable to pull the plate into engagement with at least one of the flanges;

wherein the rail includes a plurality of holes therethrough for providing access to a head of each bracket fastener to facilitate adjustment thereof.

36. The assembly of claim 35 wherein the rail is formed of plastic and each bracket is further secured thereto via melted portions of the rail.

37. The assembly of claim 35 wherein each bracket is further secured to the rail by an adhesive.

38. The assembly of claim 35 wherein the rail includes multiples pairs of protrusions in the upper slot or in the lower slot, each bracket positioned between a respective pair of protrusions for limiting lateral movement thereof.

39. The assembly of claim 35 wherein each hole in the rail includes a front surface portion extending thereabout, and wherein the head of each bracket fastener is positioned in a non-contacting arrangement relative to its respective, aligned rail front surface portion.

40. The assembly of claim 35 wherein said head of said fastener is located between said rail and said tang.

41. A bracket for coupling a rail having an upper slot and a lower slot to a shelf edge having an upper groove and a lower groove, the bracket comprising:

a central body portion;

an upper flange coupled to and extending generally upwardly from said body portion, said upper flange having a free tip end;

a lower flange coupled to and extending generally downwardly from said body portion, said lower flange having a free tip end, said upper and lower flanges each being relatively thin plate-like portions;

a plate received between said upper and said lower flanges such that as said plate is moved toward said body said plate urges said upper flange and said lower flange into said upper and lower groove, respectively, to couple said bracket to said shelf edge;

a first upper tang coupled to and extending generally upwardly from said body portion, said first upper tang including a free tip end; and a first lower tang coupled to and extending generally downwardly from said body portion, said first lower tang including a free tip end generally parallel to said free tip ends of said upper flange, said lower flange and said first upper tang, said upper tang and lower tang being shaped to be received in said upper and lower slot, respectively, and wherein at least one of said first upper tang or said first lower tang has a cut-out portion located adjacent the associated free tip end.

42. A bracket for coupling a rail having an upper slot and a lower slot to a shelf edge having an upper groove and a lower groove, the bracket comprising:

a central body portion;

an upper flange coupled to and extending generally upwardly from said body portion;

a lower flange coupled to and extending generally downwardly from said body portion;

a plate received between said upper and said lower flanges such that as said plate is moved toward said body said plate urges said upper flange and said lower flange into said upper and lower groove, respectively, to couple said bracket to said shelf edge;

a first upper tang coupled to and extending generally upwardly from said body portion; and a first lower tang coupled to and extending generally downwardly from said body portion, said upper tang and lower tang being shaped to be received in said upper and lower slot, respectively.

43. The bracket of claim 42 wherein said upper flange, said lower flange, said first upper tang, and said first lower tang each include a tip, and wherein each of said tips are generally parallel.

44. The bracket of claim 43 wherein each tip is a free, cantilevered end of the associated flange or tang.

45. The bracket of claim 44 wherein each tip is generally parallel to said body portion.

46. A rail for receiving an electronic display tag therein and for being coupled to a bracket, the rail comprising:

a central body having a front surface and a rear surface;

an upper finger extending from said front surface;

a lower finger extending from said front surface and spaced from said upper finger, said upper finger and said lower finger defining a channel to receive an electronic display tag therein; and an upper lip extending from said rear surface and defining an upper slot for receiving an upper tang of a bracket therein, said upper lip being shaped to maintain said upper tang in said upper slot;

a lower lip extending from said rear surface and defining a lower slot for receiving a lower tang of said bracket therein, said lower lip being shaped to maintain said lower tang in said lower slot.

47. The rail of claim 46 wherein said upper lip and said lower lip extend about 0.100 to about 0.150 inches along said rear surface.

48. The rail of claim 46 further comprising a pair of spaced protrusions that extend into either said upper slot or said lower slot, said protrusions being located to receive said bracket therebetween to limit the lateral sliding of said bracket in said rail.

49. The rail of claim 48 wherein said protrusions extend from said upper lip or said lower lip.

* * * * *